US005102424A

United States Patent [19]

Karsunky et al.

[11] Patent Number: 5,102,424

[45] Date of Patent: Apr. 7, 1992

[54] PIGMENT PRINTING PROCESS FOR FLAME-RETARDANT, LOW-FLAMMABILITY OR NONFLAMMABLE FIBERS: POLYMER OR COPOLYMER OF VINYLIDENE CHLORIDE AS PIGMENT BINDER

[75] Inventors: Ulrich Karsunky, Hünfelden, Fed. Rep. of Germany; Anna G. Morrison, Huddersfield, Great Britain; Horst-Roland Mach, Glashütten, Fed. Rep. of Germany

[73] Assignee: Hoechst Aktiengesellschaft, Frankfurt, Fed. Rep. of Germany

[21] Appl. No.: 546,580

[22] Filed: Jun. 29, 1990

[30] Foreign Application Priority Data

Jun. 30, 1989 [DE] Fed. Rep. of Germany ..... 3921448

[51] Int. Cl.[5] ..... B41M 1/12; B41M 5/26; D06M 15/24; D06P 1/44

[52] U.S. Cl. ..... 8/490; 8/558; 8/614; 8/636; 8/925

[58] Field of Search ..... 8/636, 490, 558

[56] References Cited

U.S. PATENT DOCUMENTS

| | | | |
|---|---|---|---|
| Re. 30,783 | 10/1981 | Kleiner et al. | 528/287 |
| 3,941,752 | 3/1976 | Kleiner et al. | 528/287 |
| 4,788,008 | 11/1988 | Neubert | 106/18.14 |
| 4,927,698 | 5/1990 | Jaco et al. | 428/198 |

FOREIGN PATENT DOCUMENTS 2400191 7/1975 Fed. Rep. of Germany .

*Primary Examiner*—A. Lionel Clingman

[57] ABSTRACT

Pigment printing process for flame-retardant, low-flammability or nonflammable fibers On being printed with conventional pigment print pastes low-flammability fibers lose their flame-retardant properties in the areas covered with the print paste. It was therefore necessary to find a binder system which itself has low-flammability properties.

By using polymers and/or copolymers of vinylidene chloride as pigment binder system the low flammability of such special types of fiber is not impaired.

5 Claims, No Drawings

PIGMENT PRINTING PROCESS FOR FLAME-RETARDANT, LOW-FLAMMABILITY OR NONFLAMMABLE FIBERS: POLYMER OR COPOLYMER OF VINYLIDENE CHLORIDE AS PIGMENT BINDERDESCRIPTION

The present invention relates to a printing process for pigments in conjunction with a binder system on textile fabrics formed from flame-retardant, low-flammability or nonflammable synthetic fibers.

Pigment printing processes for the coloristic patterning of sheetlike textile material are common knowledge in the art and have long been practiced all over the world. In pigment printing, the particular pigments are usually applied to the textile web from aqueous print pastes together with a binder system and then dried. A subsequent dry heat treatment for curing the preferably synthetic resin binder system and hence fixing the applied colorant concludes the printing process.

However, the use of the hitherto customary binder systems has shown that flame-retardant, low-flammability or nonflammable fiber materials—or otherwise inherently flammable fibers which have been specifically finished for this purpose—lose their flame resistance in the areas covered with the print paste or that the characteristics typical of this type of fiber, which in many cases are directly prescribed for the intended specific industrial wear and contract business, deteriorate at least to such an extent that the required safety level is no longer ensured. Such an adverse effect, which is caused by the conventional pigment binder system used in the coloring, also obtains when, for example, a flame-retardant finish is applied to flammable fibers after printing.

In particular, however, even synthetic fibers which, owing to an individual modification of their chemical structure, are inherently flame-resistant lose this special property.

The production of such fibers is described inter alia in German Patent Specification DE-C-2 346 787. The underlying fiber substance starting materials are in this case linear phthalic esters containing, as cocondensed units in the polymer chain, phosphorus-containing structural units which are derived from carboxyphosphinic acids (phospholanes).

Further examples of high temperature resistant or fire-proof types of fiber are those based on aromatic polyamides (aramid) formed from aromatic diamines (such as m-phenylenediamine) and arylenedicarboxylic acids (such as isophthalic acid), or based on polybenzimidazoles (PBI fibers) composed from aromatic tetramines and isophthalic esters (cf. Römpps Chemie-Lexikon, 8th edition, pages 257 and 3279).

If the binder systems which are at present commercially available and recommended for textile printing are considered, it is found that, without exception, they are all readily flammable.

The flammability rating is of course affected not only by the binder system but also to a certain extent by the addon, i.e. the amount of substance applied to the fabric surface.

It is an object of the invention which will be explained hereinafter to preserve the flame-resistant properties of textiles consisting of flame-retardant, low-flammability or nonflammable fibers after printing with pigments and a binder system or not to impair the flame-resistant properties of a flameproofing finish applied after printing with pigments and a binder system.

This object is achieved according to the present invention by the use of a pigment binder system based on polymers and/or copolymers of vinylidene chloride.

The preferred binders for the claimed process are copolymers having a polyvinylidene chloride content of from 70 to 90% by weight, in particular those based on vinylidene chloride and butyl acrylate.

The particular amounts used of the polymers and/or copolymers in question vary between 100 and 200 parts by weight per kilo of print paste.

It is true, then, that European Patent Application EP-A-0 286 202 already discloses that such predominantly polyvinylidene chloride copolymers can be used together with flame-retardant substances, for example halogenated waxes, metal salts and the like, as constituents of a latex for a flame-retardant finish of paper in the form of a coating or else for bonding flameproof fibers (e.g. glass fibers). However, to date no one has addressed the problem that conventional, generally inherently flammable binder systems used in pigment printing impair—or even eliminate—the substrate-specific characteristics of flame-retardant fibers and that consequently the required safety standard is no longer guaranteed.

Given these circumstances, it was therefore not easily foreseeable that the utility of the copolymers of vinylidene chloride which were known from EP-A-0 286 202 is without reservation also exploitable for the printing of pigments on flame-retardant fiber materials, since on the one hand the coating described therein constitutes an all over finish of the substrate which requires the essential support of further flame-retardant substances and in particular since this state of the art does not reveal anywhere anything which might suggest an independently flame-retardant effect of the polyvinylidene chloride or copolymers thereof used as the latex.

In its practise the process according to the present invention does not differ from the usual pigment printing process:

The print pastes containing the binder system according to the invention are preferably thickened with low-solids, synthetic thickeners, or else with emulsion thickenings. The plasticizers used for improving the hand of the printed fabric are the usual products for this purpose, e.g. dioctyl phthalate, in amounts of 30–50 parts by weight per kilo of print paste.

Regardless of the composition of the print paste, the pigments used in the claimed process can in principle be any of the inorganic and in particular organic compounds listed under the generic heading of "C.I. Pigments" in the COLOUR INDEX, 3rd edition 1971 and supplements 1975, 1982 and 1987.

The pigment-containing print pastes thus prepared are printed onto the textile material in a conventional manner, and the resulting pattern is dried and then fixed as usual by dry heat.

The Examples which follow indicate the general method of working in the form of guideline recipes. They can be varied within wide limits according to operating requirements. The percentages are by weight.

EXAMPLE 1

A print paste is prepared starting with 72% of a conventional oil-in-water emulsion, to which are added in succession with vigorous stirring 2% of Pigment Orange 43 (C.I. No. 71105), 20% of a binder based on a copolymer of vinylidene chloride and butyl acrylate with a polyvinylidene chloride content of 70%, 5% of dioctyl phthalate as plasticizer and also 1% of an aqueous ammonia solution (20% strength).

The print paste thus produced is flat screen printed onto a fabric woven from a flame-retardant polyester fiber as described in DE-C-2 346 787, which has been modified by integration of an organic phosphorus compound in the molecular chain, dried at 100°-130° C. and then fixed at 130° C., preferably by treatment with hot air, for 3 minutes with condensation of the binder.

The result obtained is an orange print which meets the requirements of German Standard Specification DIN 4102 part 1 classes B1 and B2 concerning the flammability rating of building materials and structural components.

EXAMPLE 2

A print paste of the composition specified hereinafter is obtained on first introducing as a synthetic thickening 83% of a 2% strength foam produced from an uncrosslinked high molecular weight polyacrylic acid, neutralized with ammonia, and then adding with vigorous stirring 3% of Pigment Yellow 83 (C.I. No. 21108), 10% of a binder based on a vinylidene chloride/butyl acrylate copolymer with a polyvinylidene chloride content of 90%, 3% of dioctyl phthalate as plasticizer and also 1% of an aqueous ammonia solution (20% strength).

This print paste is roller screen printed onto a fabric made of low-flammability polyester fibers (linear polyterephthalic esters with cocondensed phosphorus-containing chain members) and fixed thereon by thermal aftertreatment a described in Example 1.

The result obtained is a yellow print which meets the safety provisions of German Standard Specification DIN 4102 part 1 class B2 concerning the flammability rating of building materials and structural components.

If the above print is subsequently subjected to a customary wash, the subsequent burn test also meets the requirements of class B1 of the above DIN German standard specification.

EXAMPLE 3

A print paste is prepared as follows:

To 81% of a conventional oil-in-water emulsion are added in succession with stirring 2% of Pigment Blue 15:1 (C.I. No. 74160), 15% of a binder based on 90% of polyvinylidene chloride with butyl acrylate as copolymer, and 2% of diammonium phosphate as catalyst.

The resulting print paste is roller screen printed onto a fabric made of low-flammability polyester fibers (linear polyterephthalic esters containing cocondensed phosphorus-containing chain members) and heat fixed thereon by an aftertreatment as described in Example 1.

The result obtained is a blue print which meets the low flammability requirements of textile products.

However, if in the preceding Example the amount of binder used is replaced by a binder based on a copolymer of butyl acrylate with vinyl acetate, the result obtained is a blue print which in the fire cell test no longer meets the flammability requirements of the abovementioned DIN German standard specification. Nor does a subsequent wash bring any improvement.

We claim:

1. A process for preserving the flame-retardant properties of textile fibers formed from flame-retardant, low-flammability or nonflammable synthetic organic fibers in a process for printing said textile fibers with a printing paste containing an inorganic or organic compound listed under the generic heading of C.I. Pigments in the Colour Index and a binder system, drying the printed material and fixing the said inorganic or organic compound on said material by dry heat, in which process the binder system employed comprises a vinylidene chloride polymer and/or a vinylidene chloride/butyl acrylate copolymer having a vinylidene chloride content between about 70 to about 90% by weight.

2. The process as claimed in claim 1, wherein the plasticizer used for the pigment binder systems mentioned is diocityl phthalate.

3. The process as claimed in claim 1, wherein the textiles printed consist of linear phthalic ester fibers with cocondensed phosphorus-containing chain members.

4. The process as claimed in claim 1, wherein the textiles printed consist of types of fiber based on aromatic polyamides or polybenzimidazoles or combinations thereof.

5. A process as claimed in claim 1, wherein said printing paste contains 10 to 20% by weight of said binder system.

* * * * *